US006644540B2

(12) United States Patent
Jamitzky et al.

(10) Patent No.: US 6,644,540 B2
(45) Date of Patent: Nov. 11, 2003

(54) PACKAGING UNIT

(75) Inventors: Walter Jamitzky, Augsburg (DE); Georg Wettlaufer, Garmisch-Partenkirchen (DE)

(73) Assignee: Octagon Handels GmbH (DE)

( * ) Notice: Subject to any disclaimer, the term of this patent is extended or adjusted under 35 U.S.C. 154(b) by 0 days.

(21) Appl. No.: 10/066,433

(22) Filed: Jan. 31, 2002

(65) Prior Publication Data

US 2002/0125306 A1 Sep. 12, 2002

(30) Foreign Application Priority Data

Mar. 12, 2001 (DE) ..... 101 12 164

(51) Int. Cl.[7] ..... B65D 25/04; B65D 5/486

(52) U.S. Cl. ..... 229/120.11; 229/117; 229/120.18; 229/904

(58) Field of Search ..... 229/117, 120.11, 229/120.18, 904; 220/503, 505, 737, 738; 206/217, 565

(56) References Cited

U.S. PATENT DOCUMENTS

| | | | | | |
|---|---|---|---|---|---|
| 1,801,148 | A | * | 4/1931 | Gilson | 220/737 |
| 2,774,468 | A | * | 12/1956 | Rous | 229/120.18 |
| 3,510,046 | A | * | 5/1970 | Reiner | 229/120.18 |
| 3,640,380 | A | * | 2/1972 | Huffman | 229/904 |
| 4,397,393 | A | * | 8/1983 | Pergande et al. | 229/904 |
| 4,491,220 | A | * | 1/1985 | Daviss | 206/217 |
| 4,620,631 | A | * | 11/1986 | Bartelt | 206/217 |
| 5,137,210 | A | * | 8/1992 | Hibbs | 229/120.18 |
| 5,630,544 | A | | 5/1997 | Shane | |
| 5,775,570 | A | | 7/1998 | Kim | |
| 6,102,208 | A | * | 8/2000 | Huang | 229/120.18 |
| 6,394,265 | B1 | * | 5/2002 | Tsao | 229/904 |

FOREIGN PATENT DOCUMENTS

| | | |
|---|---|---|
| DE | 29623595 | 1/1999 |

* cited by examiner

*Primary Examiner*—Gary E. Elkins
(74) *Attorney, Agent, or Firm*—Greer, Burns & Crain, Ltd.

(57) ABSTRACT

The packaging unit comprises a receiving chamber for popcorn, or the like, the outside thereof having secured thereto a pocket into which a beverage cup is insertable such that said cup is seated in a clamp seat. The packaging unit can comfortably be carried by a user gripping around the pocket with one hand. If the packaging unit is made from a one-part blank, it can be produced and erected easily.

15 Claims, 2 Drawing Sheets

PACKAGING UNIT

The present invention relates to a packaging unit comprising a receiving chamber provided with a bottom for receiving popcorn, or the like.

It is widely known that e.g. people who are visiting movie theaters or so-called multiplexes take along popcorn, corn chips, or the like, together with a drink into the performance room; these were bought by them at a booth or in a sales room of the movie theater before. Popcorn, or the like, is offered in a bag or a packaging made from cardboard and the drink is offered in a separate beverage cup. It is quite uncomfortable for a visitor to transport and hold the two separate packaging units, for which he mostly needs both of his hands.

The same problem can be observed in other events, such as sports events, at fairs or exhibitions when visitors have bought a bag or a box containing food or edibles and a drink.

It is the object of the present invention to provide a packaging unit with which e.g. popcorn or chips, but also French fries, pastry, pasta, fried poultry, fried fish, etc., as well as a beverage can be carried with one hand in a so-called combination package.

This object is achieved according to the invention by the features of patent claim 1. Advantageous developments of the invention are characterized in the subclaims.

The invention provides a packaging unit comprising a receiving chamber provided with a bottom for receiving popcorn, or the like, wherein a mounting, hereinafter called "pocket", is secured to the receiving chamber on the outside and a beverage cup can be inserted into said mounting. The packaging unit is made from cardboard of a rigid paper quality or, for example, also from plastics.

Preferably, the beverage container has the shape of a cup which is slightly conically enlarged upwards and which can be inserted into the pocket in a clamp seat. The pocket is thereby firmly clamped around the cup, whereby cup and pocket form a rigid unit which is sufficiently stable to withstand pressure exerted from the outside. Since the pocket is secured to the side wall of the receiving chamber, such a combination package according to the invention can easily be carried by one hand gripping around the pocket.

As a rule, an annular holding loop or an annular holding tongue, for example, can also be secured as a mounting to the receiving chamber on the outside.

Preferably, when viewed in ground plan, the receiving chamber has a cornered shape which may be rectangular or square. If in accordance with a further suggestion of the invention the pocket is secured in the area of a corner, this results in a particularly stable unit consisting of receiving chamber and pocket.

While the receiving chamber for receiving popcorn etc. comprises a bottom, this is not necessary for the insertion pocket. It preferably consists of only one side wall enclosing the inserted beverage cup. It is however within the scope of the invention that the pocket may also be provided with a bottom on which the beverage container may rest, and said container need also not be inserted in a clamp seat by necessity, though this constitutes the preferred embodiment of the invention.

According to a further advantageous suggestion, the pocket is formed of side parts passing into one another via fold lines. It is here expedient that the fold lines extend in parallel with one another, so that the pocket has a constant cross-section over its height. This, however, is not imperative; the fold lines may also extend at an angle relative to one another, so that the pocket is upwardly enlarged.

Expediently, three side parts are provided that are preferably of the same width so that the pocket (before insertion of the beverage cup) has a square ground plan. The fourth side is preferably formed by the associated side part of the receiving chamber.

As an alternative, the pocket may also consist of four side parts of its own, of which one is adhesively fastened to the receiving chamber on the outside.

If only three side parts are provided for the pocket, the first and third side parts may each be provided with a fastening tongue which is adhesively secured to the outer wall of the receiving chamber.

In a particularly preferred embodiment of the packaging unit, the pocket is however not formed from a blank separated from the receiving chamber, but the receiving chamber and the pocket are made from a one-part blank. This considerably simplifies the manufacture of the packaging unit according to the invention. In further details, according to one suggestion, a side part of the receiving chamber provided at one end passes into a side part of the pocket, and the opposite side part of the pocket passes via a fold line into a fastening tongue which is fastened to the neighboring side part of the receiving chamber on the outside. As has already been mentioned, such a fastening is carried out by gluing whenever the packaging unit is made from cardboard, while sealing is also possible in the case of a packaging unit of plastics.

Furthermore, it is suggested that the lower edge of the pocket should be in alignment with the bottom edge of the receiving chamber. The invention, however, is not limited thereto, but the pocket can also terminate above the lower edge of the receiving chamber.

Expediently, the upper edge of the pocket ends below the upper edge of the receiving chamber, which need not necessarily be the case. In an expedient embodiment of the invention, the pocket extends over about 60 to 80% of the height of the receiving chamber.

The upper edges of the side parts of the pocket may have a curved shape, a flat section of the shape of a circular arc being e.g. cut away such that the corner portions have the largest height.

The insertion pocket need not necessarily be formed from side parts separated by fold lines—although this is of particular advantage. As a rule, the pocket might also have a circular cylindrical shape or a frustoconical shape, which, however, makes the manufacture of the packaging unit more expensive.

The packaging unit according to the invention can be carried along and held with one hand not only in a comfortable manner but it also simplifies and expedites the delivery or sale of popcorn, or the like, and of an accompanying drink, which is very desirable especially for movie theaters or so-called multiplexes because shortly before the beginning of a show there is a great demand for popcorn, or the like, with an accompanying drink, and this demand can be satisfied much faster with the help of the combination package according to the invention.

Further details of the invention will become apparent from the following description of an embodiment of the packaging unit according to the invention and from the drawings, in which.

Figure 1:
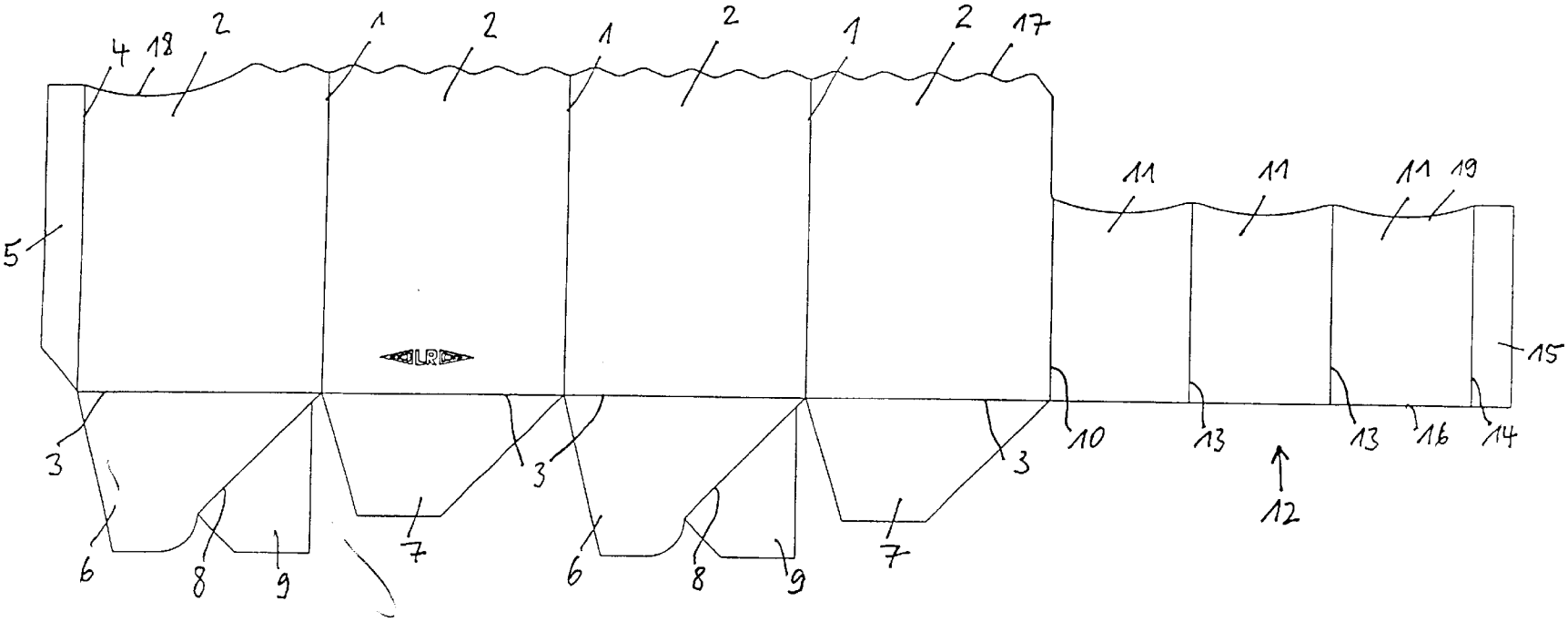
FIG. 1 shows the one-part blank of the packaging unit.

The blank illustrated in FIG. 1 shows four side parts 2 of a receiving chamber 21 for receiving popcorn, or the like, the side parts 2 being separated from one another by hinge folds 1 and passing at their lower edges via further hinge folds 3 into bottom parts. The side part 2 that is the left one in the figure passes via a further hinge fold 4 into an adhesive tongue 5 which is adhesively fastened to the inside of the right side part 2.

The alternately arranged bottom parts 6 and 7 grip over one another in the erected state of the packaging unit, the bottom parts 6 passing via inclined hinge folds into bottom sections 9 which are glued to the neighboring bottom parts 7.

The side part 2 of the receiving chamber that is the right one in the figure preferably passes via a fold line 10 into the side parts 11 of the insertion pocket 12. The side parts 11 are subdivided by hinge folds 13, followed via a fold line 14 by an adhesive tongue 15 which is adhesively fastened to the outside of the left side part 2 of the receiving chamber 21.

The lower edges 16 of the side parts 11 are in alignment with the hinge folds 3 and the lower edges of the side parts 2, respectively.

The upper edges 17 of the side parts 2 have a corrugated shape, the left side part 2 having a section 18 shaped in the form of a circular arc.

The upper edges 19 of the side parts 11 have the shape of a circular arc extending in symmetry with the central longitudinal axis of the side parts 11.

Figure 2:
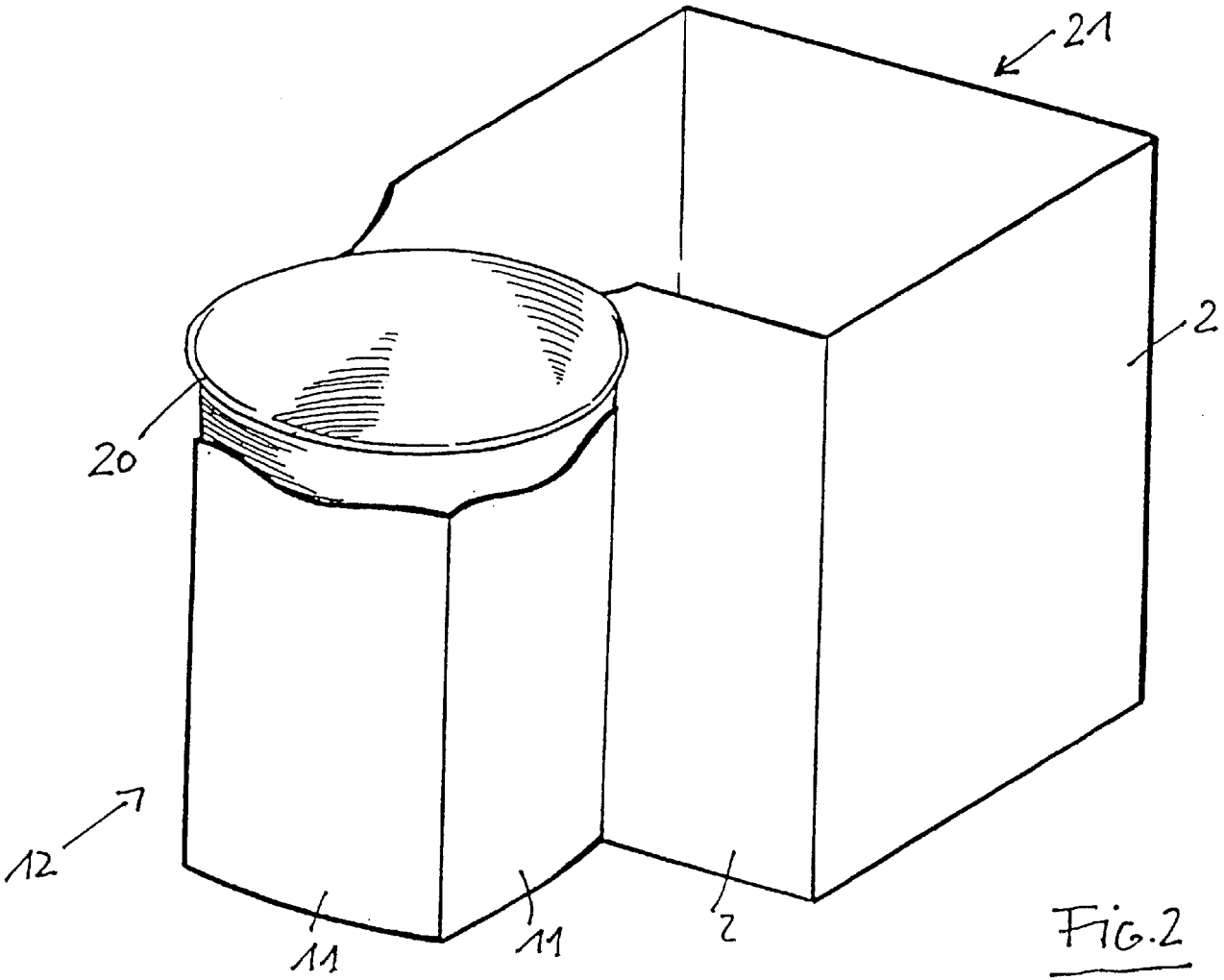
FIG. 2 is a perspective view of the packaging unit.

The packaging unit which is formed from the described blank is shown in FIG. 2 in a state in which a beverage cup 20 is inserted into the pocket 12. The beverage cup 20 is positioned in a clamp seat in the pocket 12, whereby the beverage cup 20 is safely held therein. A user can comfortably carry the packaging unit in said state by gripping around the pocket 12 with one hand.

The combination packaging according to the invention is e.g. also best suited for fast food restaurants, kiosks, etc.

What is claimed is:

1. A packaging unit comprising, a receiving chamber for food;

a mounting adapted to receive a beverage cup secured to the outside of said receiving chamber, said receiving chamber having at least one corner when viewed in ground plan, and said mounting being secured adjacent said corner, said mounting being formed from side parts extending into one another via fold lines, and wherein the upper edges of said side parts of said mounting have a curved shape where corner areas have a larger height than central areas of said mounting side parts; and said receiving chamber and said mounting being formed from a one-part blank, whereby the packaging unit may be carried by a patron with one hand by gripping said mounting.

2. A packaging unit according to claim 1 wherein the cup is conically enlarged upwardly, said mounting adapted to clamp the cup.

3. The packaging unit according to claim 1, wherein said fold lines extend in parallel with one another.

4. The packaging unit according to claim 1, wherein there are three said side parts having the same width.

5. The packaging unit according to claim 1, wherein said receiving chamber is formed of side parts, and wherein one of said side parts of said receiving chamber extends via a fold line into one of said side parts of said mounting, and that another of said mounting side parts extends via a fold line into a fastening tongue which is secured to another of said side parts of said receiving chamber.

6. The packaging unit according to claim 1, wherein the lower edges of said side parts of said mounting are in alignment with one another.

7. The packaging unit according to claim 1, wherein the lower edges of said side parts of said mounting are in alignment with the bottom edges of said receiving chamber.

8. The packaging unit according to claim 1, wherein said mounting has a smaller height than said receiving chamber.

9. A packaging unit comprising, a receiving chamber for food, having at least one corner when viewed in ground plan, said receiving chamber having a plurality of side parts separated by fold lines;

a mounting connected to said corner of said receiving chamber, said mounting having first, second and third side parts separated by fold lines;

a tongue connected to said mounting;

said receiving chamber, said mounting and said tongue being formed from a one-part blank, the first side part of said mounting being unitary with a side part of said receiving chamber, and the third side part of said mounting being unitary with said tongue, said tongue attached to said receiving chamber; and a cup for a beverage, said cup being slightly conically enlarged upwards, said cup being removably inserted into said mounting in a clamp seat.

10. The packaging unit according to claim 9, wherein said fold lines of said mounting extend in parallel with one another.

11. The packaging unit according to claim 9, wherein the lower edges of said side parts of said mounting are in alignment with one another.

12. The packaging unit according to claim 9, wherein the lower edges of said side parts of said mounting are in alignment with the bottom edges of said receiving chamber.

13. The packaging unit according to claim 9, wherein said mounting has a smaller height than said receiving chamber.

14. The packaging unit according to claim 9, wherein the upper edges of said side parts of said mounting have a curved shape where corner areas have a larger height than central areas of said mounting side parts.

15. A packaging unit comprising, a receiving chamber for food, said receiving chamber having side parts;

a mounting adapted for receiving a beverage cup, said mounting secured to the outside of said receiving chamber, said mounting having side parts being an extension of said receiving chamber side parts and being separated there from by a fold line; and upper edges of said side parts of said mounting have a curved shape where corner areas have a larger height than central areas of said mounting side parts.

* * * * *